US006500318B2

(12) United States Patent
Gowans et al.

(10) Patent No.: US 6,500,318 B2
(45) Date of Patent: Dec. 31, 2002

(54) APPARATUS FOR RECOVERING METAL FROM SOLUTION

(75) Inventors: Bruce S. Gowans, Hemel Hempstead (GB); Christopher B. Rider, New Malden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/829,733

(22) Filed: Apr. 10, 2001

(65) Prior Publication Data

US 2001/0011636 A1 Aug. 9, 2001

Related U.S. Application Data

(63) Continuation of application No. 09/352,510, filed on Jul. 12, 1999, now abandoned.

(30) Foreign Application Priority Data

Jul. 13, 1998 (GB) ..... 9815172

(51) Int. Cl.[7] ..... C25B 9/00; C25C 7/00; C25D 17/00

(52) U.S. Cl. ..... 204/242; 204/271; 204/275.1; 204/286.1; 204/272

(58) Field of Search ..... 204/242, 271, 204/275.1, 286.1, 272, 294; 205/565, 571

(56) References Cited

U.S. PATENT DOCUMENTS

| | | | | | |
|---|---|---|---|---|---|
| 317,246 | A | | 5/1885 | Thompson | |
| 4,054,503 | A | | 10/1977 | Higgins | |
| 4,280,884 | A | | 7/1981 | Babb et al. | |
| 4,372,829 | A | | 2/1983 | Cox | |
| 4,384,939 | A | | 5/1983 | Kim et al. | |
| 4,440,616 | A | | 4/1984 | Houseman | |
| 4,675,085 | A | * | 6/1987 | Vasquez | 204/272 |
| 4,834,849 | A | | 5/1989 | Woog | |
| 5,203,979 | A | | 4/1993 | Uffinger et al. | |
| 5,370,781 | A | | 12/1994 | Van de Wynckel et al. | |
| 5,401,374 | A | * | 3/1995 | Leutwyler | 204/272 |
| 5,753,099 | A | * | 5/1998 | Gravel et al. | 204/271 |
| 6,071,399 | A | | 6/2000 | Van der Bergen et al. | |

* cited by examiner

*Primary Examiner*—Nam Nguyen
*Assistant Examiner*—Wesley A. Nicolas

(57) ABSTRACT

An electrolytic cell for the recovery of silver from a photographic fixer solution has a cylindrical cathode secured to and depending downwardly from a screw-on lid of the cell into the solution. The cathode is formed from a sheet of graphite foil laminated to a polyester base, and is clamped at its upper periphery around a boss of the lid. A metal connection ring is embedded around the outer periphery of the base and is contacted by the cathode. This arrangement is particularly suitable for allowing a thin, flexible disposable cathode to be conveniently removed from the cell by means of the lid, without the user being exposed to contact with the silver or with the solution.

20 Claims, 4 Drawing Sheets

APPARATUS FOR RECOVERING METAL FROM SOLUTION

CROSS-REFERENCE TO RELATED APPLICATION

This is a Continuation of application Ser. No. 09/352,510 filed Jul. 12, 1999, now abandoned.

FIELD OF THE INVENTION

This invention relates to the recovery of metal from solution, and in particular to an electrolytic cell for the recovery of metal from metal rich solution contained therein by plating onto a cathode thereof. The invention finds particular, though not exclusive, application in the electrical and mechanical connection of cathodes for use in an electrolysis cell used in the recovery of silver from photo-processing solutions.

BACKGROOUND OF THE INVENTION

For convenience and by way of example only, the invention will be described with respect to the recovery of silver from photo-processing solutions, it being understood that it has more general application.

In electrolytic silver recovery apparatus, current is passed between the anode and cathode of a cell, and silver from the solution contained therein, for example a photographic fixing solution, becomes plated onto the cathode. The amount of silver on the cathode increases with usage, and ultimately the maximum capacity of silver plating is reached. At this stage it is necessary to remove the cathode from the cell and either to replace it with a fresh one, or alternatively to detach the silver and to replace the original cathode. Whilst there are cost savings involved in reusing the same cathode, substantial labor costs can be incurred in removing and cleaning the cathode. To minimize the inconvenience of having to separate the silver from the cathode, it is known to use a disposable cathode which is smelted together with the silver thereon in a subsequent refining process. Examples of this are disclosed in U.S. Pat. Nos. 4,440,616, 5,203,979, and 5,370,781. In this way, although the labor cost associated with separating the silver from the cathode is reduced, the user is still required to undertake the messy and inconvenient operation of having to remove from the cell a cathode that is not only coated with silver but also is wet with the solution.

U.S. Pat. No. 4,834,849 discloses an apparatus for recovering a conductive metal from a liquid that contains that metal, in which the container is constructed of a plastics material and the cathode is provided in the form of a thin film applied to the inner surface thereof. With this construction, the entire container can be placed in a smelting furnace on completion of the de-metallizing operation. Whilst this avoids the need to take the fully-loaded cathode out of the cell, the user is required to drain the solution from the container and subsequently to refill the replacement container.

U.S. Pat. No. 4,372,829 discloses an apparatus for removing metal from solution, in which the cathode of the arrangement is mechanically attached to the lid of the cell, and is thus removable therewith. In this way, the user is not required to make contact with the liquid nor to drain or to refill the cell. Since the cathode is connected only to the lid, electrical connection is made therethrough. This is achieved by a plurality of studs that are welded to the top edge of the cylindrical cathode, extend through apertures in the lid and are secured by external nuts. However, this is an expensive construction and does not lend itself to use with a disposable cathode.

U.S. Pat. No. 4,280,884 discloses another approach to connecting the cathode to the lid of the cell. The stainless steel cylindrical cathode is of sufficient wall thickness for it to be retained by bolts extending axially thereinto through the lid. However, such a construction does not lend itself to the production of a low cost cell, for example, one using non-metallic cathode materials.

U.S. Pat. No. 5,370,781, referred to above, provides a solution to the problem of connection to a thin flexible cathode, in the form of a sheet that is conductive on at least one surface, by depending on shaping of the lid to press the cathode outwards onto a metal contact located in the side wall of the cell. However, since the cathode is not mechanically connected to the lid, the user has to pull the cathode, which will be wet and fully loaded with silver, out of the cell by hand or by means of a tool.

Problem to be Solved by the Invention

It is one object of the present invention to provide an electrolytic cell in which electrical connection is made to a fully-loaded cathode, preferably a disposable cathode, in such a way that the cathode may be removed from solution in a cell with the minimum of inconvenience to the user. In particular, it is an object of the invention that any contact of the user with the metal on the cathode of the cell or with any solution remaining thereon, is minimized, and preferably is obviated.

SUMMARY OF THE INVENTION

In accordance with one aspect of the present invention, there is provided an electrolytic cell for the recovery of metal from solution contained therein by plating onto a cathode thereof, the cell comprising:

an open-topped container for containing the solution;

a closure arrangement for closing the top of the container to seal the solution therein; and a cathode; wherein the closure arrangement comprises (a) electrically insulating support means for supporting the cathode such that it extends into the solution in the container, for example around the inside thereof, and (b) electrical connection means that comprises a first part, which may be contained within the closure arrangement, in electrical contact with the cathode, and a second part that extends from the first part and out through the closure arrangement.

The cathode may extend around the support means such that the inner surface of the cathode engages an exposed outer surface of the first part of the electrical connection means.

Preferably the first part of the electrical connection means is substantially annular and is embedded in the support member.

The support means may be integral with the closure arrangement, or may be separate from, and mounted on, the closure arrangement. The closure arrangement may comprise a lid of the container that is secured thereto, for example by being screwed thereon or attached by means of a bayonet fitting or a clamp, so as to seal the container against escape of the solution.

In another embodiment, the support member is urged down onto an internal recess or step of the container by the closure arrangement, for example by a lid thereof, which may be hinged to the container.

The cathode may be compressed onto at least a portion of the support means, thereby making electrical contact between an inner surface of the cathode and the first part of the electrical connection means, preferably by an annular compression ring.

In another embodiment, an inner portion of the support means may urge the cathode outwards into gripping contact with an outer portion thereof. The electrical connection means may be mounted on the outer portion of the support means.

In a preferred embodiment, the cathode is formed into an open-right cylinder having a conductive inner surface and makes electrical contact with an annular connection ring that forms the first part of the electrical connection means. The ring may be mounted on a cylindrical boss that depends downwardly from the lid.

In another embodiment, one of the cathode and support member comprises at least one projection that is arranged to engage with at least one aperture of the other of the cathode and support member, whereby the cathode may be mounted around the support member under tension.

The cell may be provided with an air bleed hole to facilitate introduction of the cathode into the liquid-filled container and to minimize the amount of liquid sucked out on its removal therefrom. The bleed hole extends from within the cathode space, and may terminate within or outside the container.

The cathode may be retained on the support means by a cam arrangement.

The cathode, preferably in cylindrical form, may be of a thin and flexible construction, and is advantageously formed from a conductive material supported by, for example laminated with, a non-conductive substrate. Preferably, the cathode comprises graphite supported by, for example in the form of a foil laminated to, a polyester backing sheet. With this construction, a low cost, easily disposable cathode can be achieved.

Advantageous Effects of the Invention

It will be appreciated that with both mechanical and electrical connection to the cathode being made upwardly to the closure arrangement, the cathode may be conveniently and safely removed from the container by the user, minimizing exposure to the plated metal and to the solution.

The cathode can conveniently be formed from a low cost flexible sheet of material, and when silver, non-metallic, or low in metal content (other than silver), may be refined together with the metal plated thereon.

When the cathode is formed of a non-metallic material, electrical connection thereto is still advantageously made by metal components. By arranging that the solution does not contact such components, for example by embedding them, plating thereon by metal from the solution is avoided.

BRIEF DESCRIPTION OF THE DRAWINGS

Embodiments of an electrolytic cell, each in accordance with the present invention, will now be described, by way of example, with reference to the accompanying drawings, in which.

DETAILED DESCRIPTION OF THE INVENTION

Figure 2:
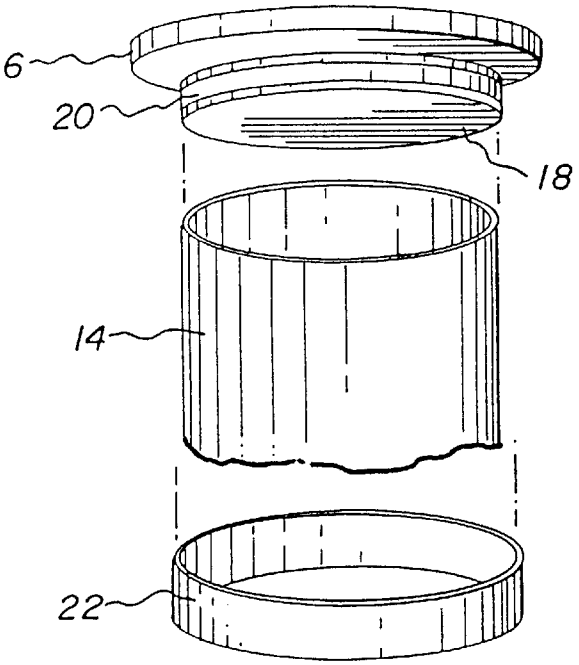
FIG. 2 is a schematic view of the cathode and lid of the cell of FIG. 1 prior to assembly.
Figure 1:
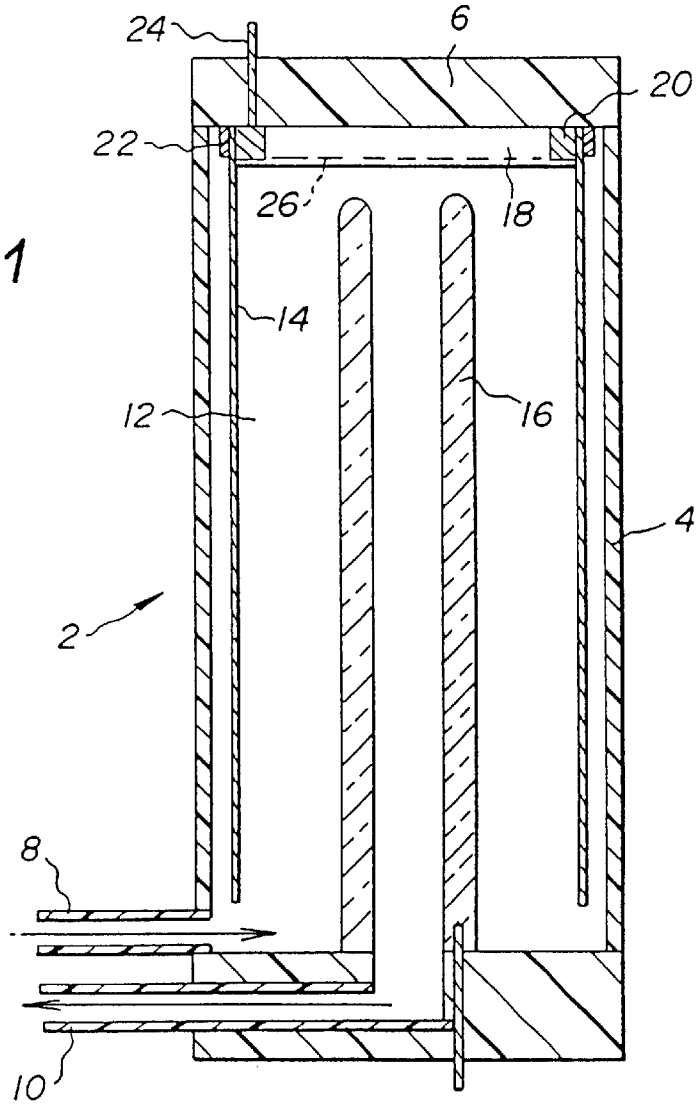
FIG. 1 is a cross-sectional schematic elevation of a first embodiment of the cell.

Referring to FIGS. 1 and 2, the cell 2 comprise a generally cylindrical container 4 that is closed at its upper end by a screw-on lid 6 formed from a non-conductive rigid material, for example polycarbonate. At its bottom end, the container 4 has an inlet 8 and an outlet 10 for the circulation of photographic fixer solution 12 therethrough. A cylindrical cathode 14 is located within the cell extending around the inner periphery of the wall thereof, and encloses a centrally-mounted upstanding tubular anode 16. The flow of the solution 12 through the cell 2 is thus from the inlet 8, upwardly through the annular space between the cathode 14 and the anode 16, then down through the tubular anode 16 and out through the outlet 10.

The lid 6 carries a cylindrical boss 18 that depends downwardly therefrom into the container 4. A conductive ring or band 20 of metal, preferably Grade 316 stainless steel, is embedded into the boss 18 around the outer circumference thereof. The upper periphery of the cathode 14 fits around the connection ring 20, and is urged into good electrical contact therewith by a circular compression band 22 of resilient material. The shaping of the boss 18 and the connection of the cathode 14 to the ring 20 ensures that the ring 20 is completely shielded from contact with the electrolytic solution 12 in the container 4. In this way, any plating of silver from the solution 12 onto the ring 20 is avoided.

The compressive force of the ring 22 is sufficient to ensure that the cathode 14 is retained on the boss 18 of the lid 6 even when it is fully laden with silver from the solution 12, thus allowing the cathode 14 to be removed safely and conveniently from the solution 12 in the container 4 simply by unscrewing the lid 6.

Electrical connection from the cathode 14 to the exterior of the cell 2, and thus to associated electrical control equipment (not shown) is made by a terminal 24 that extends from the ring 20 out through the lid 6.

Preferably, the connection ring 20 and the terminal 24 are set into the lid 6 when it is formed in a mould. Alternatively, these components may be assembled separately, for example with the ring 20 being covered by a separate shielding disk 26 as shown by dotted outline in FIG. 1.

When the cathode 14 has become fully loaded with silver, the user disconnects the power supply by removing an electrical connector (not shown) from the terminal 24. The flow of solution 12 through the cell is arranged to be stopped automatically by, for example, an interlock switch (not shown) linked to the lid 6 of the cell 2 such that when the user begins to unscrew the lid 6 from the container 4, the switch is tripped. If the electrolytic cell 2 is physically mounted with respect to an associated tank of a photoprocessor such that the level of solution in the tank is above that of the cell 2, the interlock may conveniently be arranged also to operate solenoid valves to isolate the cell 2 from the tank hydraulically. Removal of the lid 6 from the container 4 allows the cathode 14 to be withdrawn from the solution 12 without risk of contact by the user with the solution 12 or with the plated silver. The cathode 14 attached to the lid 6 may thus safely be removed to the refiner, where it may be placed into the smelter as a complete unit, provided that the small amount of stainless steel present will not unduly contaminate the silver smelting process.

Figure 3:
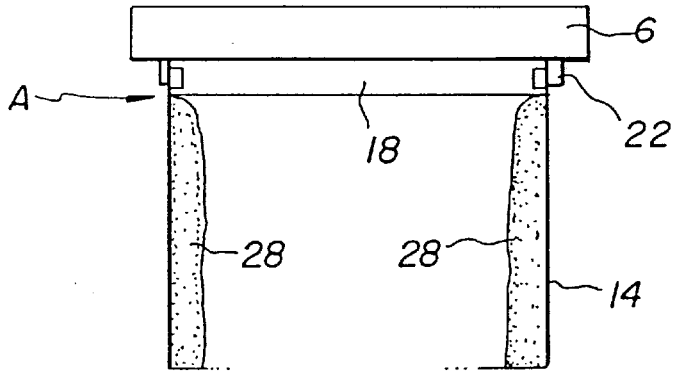
FIG. 3 shows a part of the cell of FIG. 1 after usage.

Alternatively, the cathode 14 may be separated from the lid 6. This may be achieved conveniently by removal of the compression ring 22. Alternatively, since the height of the compression ring 22 is slightly less than the projection of the boss 18 from the lid 6, the cathode 14 with its silver plating 28 may be removed from the lid 6 by a circumferential cut around the line A shown in FIG. 3.

Disconnection of the cathode 14 from the lid 6 by removing the compression ring 22 may be facilitated by the use of cams incorporated into the compression ring 22 together with the use of a wider ring around the outside thereof. Such an arrangement allows the whole ring assembly to be fitted easily over the cathode and to be such that, upon rotation, the inner ring urges the cathode 14 onto the boss 18 of the lid 6. In a further modification, the inner compression ring may be split into sections so that as the outer ring is twisted each section is pushed inwards and the overall radius of the ring decreases.

Securement of the cathode 14 onto the connection ring 20 may be enhanced by forming the ring with barbs, for example in a protrusion thereof.

In an alternative embodiment of securing the cathode 14 to the connection ring 20, the cathode may be fixed to the ring by screwing through a clearance hole in the cathode into the ring at one point, then wrapping the cathode tightly around and fixing it in place with another screw to hold the other side.

Figure 4A:
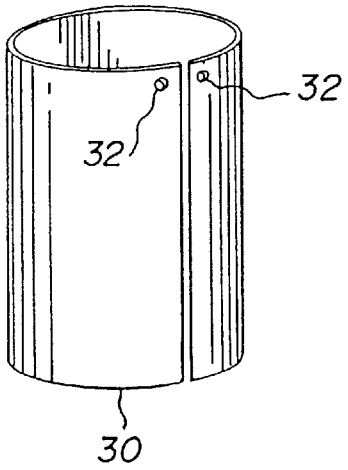
FIGS. 4*a* and 4*b* show part of an alternative embodiment of the cell.
Figure 4B:
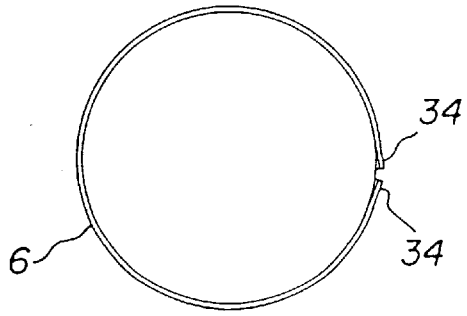

In a still further embodiment of mounting the cathode, FIG. 4a shows a slit cylindrical cathode 30 with a pair of holes 32 at the upper periphery thereof for cooperation with projections 34 of the lid 6 (FIG. 4*b*). The cathode sheet 30 is hooked onto one of the projections 34 by one the holes 32 and is then drawn around the lid 6 until the other hole 32 engages with the other projection 34. The cathode 30 is thus held in tension, ensuring good electrical and mechanical contact around the whole of the connection ring. The cathode 30 may easily be removed from the lid 6 by cutting through to one of the holes 32.

Figure 5:
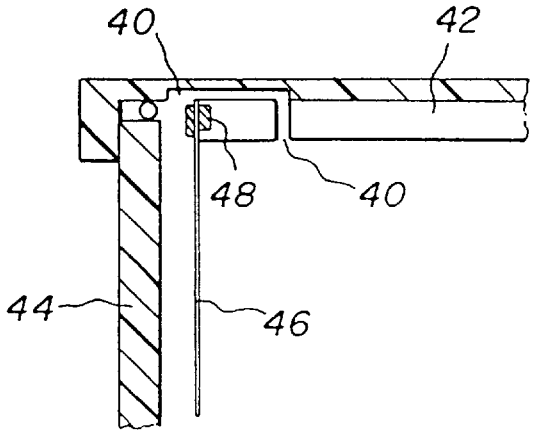
FIG. 5 shows an air vent arrangement of the cell.

It will be appreciated that the electrolytic cell of the present invention does not need to be drained when the cathode is changed and a fresh cathode is lowered into the cell, which will be full of solution. Introduction of a cathode may trap air within the volume surrounded by the cathode and the lid, causing the level of solution to rise as the cathode is lowered into the solution and possibly to overflow. The modification shown in FIG. 5 is arranged to overcome this, whereby an air passage 40 is provided through the body of the lid 42 from the volume enclosed within the cathode 46 to the annular region formed between the cathode 46 and the container 44. Such an air passage will also avoid any splashing of the solution in the container 44 upon removal of the cathode 46 therefrom. It will be appreciated that the air passage 40 is arranged not to form a path by which the electrolytic solution could contact the connection ring 48, which could give rise to plating on or corrosion thereof. An air bleed passage may alternatively be provided through the wall of the cathode 46, thus avoiding entrapment of air therein. In a still further embodiment, an air bleed passage may be provided so as to extend from within the volume defined by the cathode 46 and to terminate outside the container 44, preferably by passing through the lid 42 thereof. In this latter arrangement, it will be appreciated that, in order to maintain sealing of the container 44, the passage will need to be closable, for example by incorporation therein of a one-way valve.

An alternative closure arrangement for an electrolytic cell will now be described with reference to FIG. 6. In this embodiment, a cathode 50 is mechanically and electrically connected to a boss 52 and metal connection ring 54 as described above. The boss 52 depends from a closure disk 55 that sits in a recess 56 around the inner periphery of the upper surface of the cell 58. The cell 58 is provided with a lid 60 that is hinged at 62. When the lid 60 is secured to the container of the cell at 64, a pair of annular seals 66 are compressed, and electrical contact with the cathode 60 is made from the ring 54 via a contact 68 within the disk 55 and thence via a pressure connection to a terminal 70 that extends through the lid 60.

Figure 6:
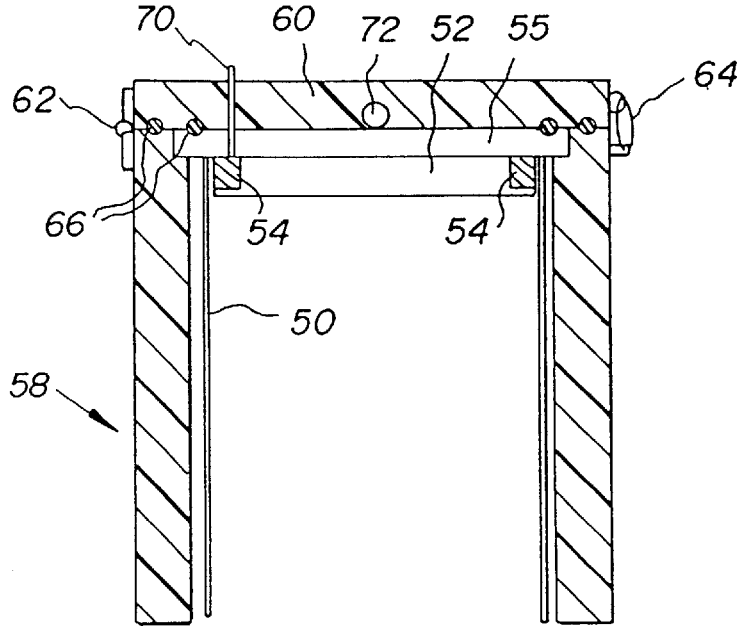
FIG. 6 is a cross-sectional schematic elevation of the upper part of a further embodiment of the cell.

The closure construction of the cell of FIG. 6 has the advantage that the same lid 60 is retained, and less of the cell 58 has to be disposed of whenever its cathode is fully loaded. This has been achieved by separating the functions of sealing the solution in the cell and mechanically supporting the cathode, the disk 55 not being physically part of the lid 60 which seals the cell 58.

The disk 55 may conveniently be provided with a handle 72 to allow convenient removal of the cathode 50 from the cell 58, the handle 72 being stored a suitable recess in the lid 60 when the cell is closed.

Figure 7:
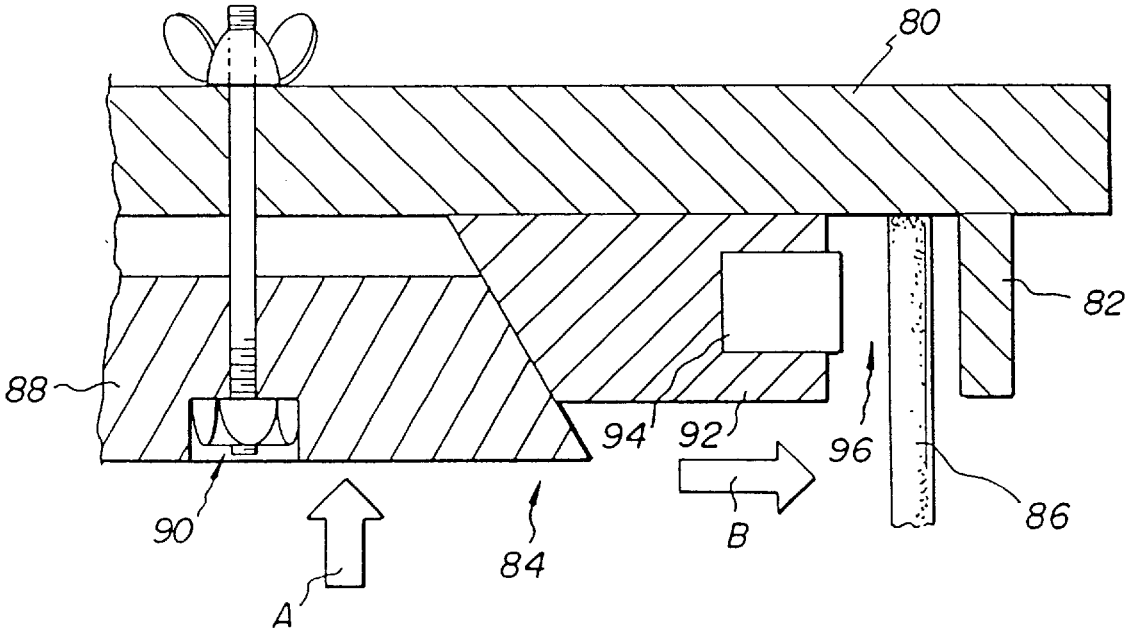
FIGS. 7 and 8 show portions of further embodiments of the cell.

FIG. 7 shows a portion of a further embodiment of the electrolytic cell, in which only parts of the lid, support arrangement and cathode are depicted. The disk-shaped lid 80 has an outer circumferential flange 82 extending downwardly therefrom. An arrangement 84 for supporting a cylindrical cathode 86 comprises a central wedge-shaped portion 88 that is retained on the lid 80 by a captive bolt 90, which is masked from the solution within the container (not shown). The central support portion 88 cooperates slidingly with an annular outer portion 92, which carries an electrical connecting ring 94 around its outer periphery. The connecting ring 94 is in multiple sections which are held together by compression springs. The closure arrangement of FIG. 7 is assembled by inserting the cylindrical cathode 86 into the annular groove 96 that exists between the outer periphery of the radially-movable support portion 92 and the flange 82 of the lid 80. The bolt 90 is then tightened, urging the central support portion 88 upwardly in the direction of arrow A towards the lid 80, and consequentially urging the sections of the outer support portion 92 apart and outwards in the direction of arrow B until the cathode 86 is firmly retained against the flange 82 and in contact with the connecting ring 94. The closure arrangement with the cathode attached may then be fitted onto the container (not shown).

In an alternative arrangement, the inner portion of the support, carrying the electrical connection for the cathode, may be fixed, and the surrounding outer portion may be arranged to be slidable inwards so as to urge the cathode, located in the groove therebetween, onto the connection.

In a modification of the embodiment of FIG. 7, the electrical connecting ring 94 may be replaced by an annular contact extending around the inner surface of the flange 82, thus making contact with the outer cylindrical surface of the cathode 86. In each of these embodiments, electrical connection from the connecting ring will be made (by means not shown) to a terminal on the outside of the lid 80.

It will be appreciated that with the assembly shown in FIG. 7, the cathode of the cell may be fitted to and detached from the lid in the vicinity of the cell, thus necessitating the sending only of the cathode, when fully loaded, to the refiner.

Figure 8:
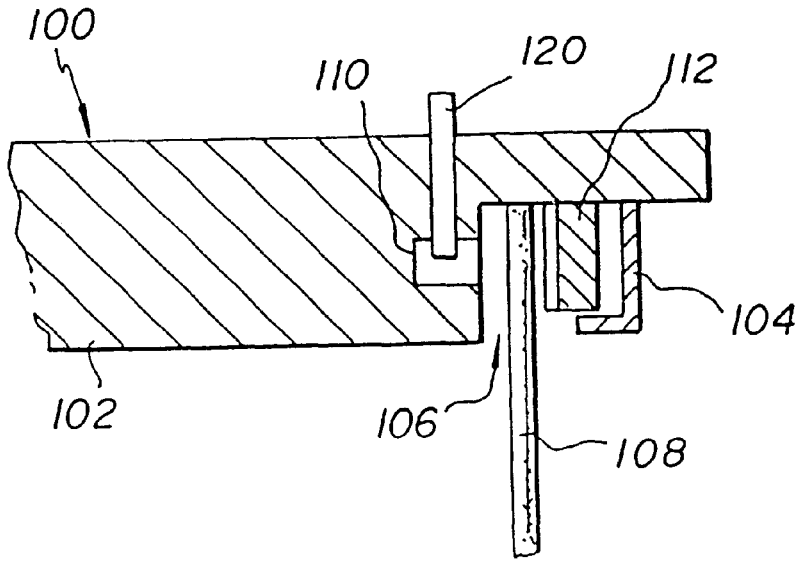

The embodiment of the cell shown in FIG. 8 also has the advantage that the cathode can be removed in situ. In this embodiment, the lid 100 of the cell has a central internal boss 102 and, annularly-spaced therefrom an inwardly-directed L-shaped flange 104 defining a groove 106 therewith. The groove 106 receives one edge of a cylindrical cathode 108, which is urged against an annular connecting ring 110 mounted on the boss 102. The cathode 108 is urged on to the connecting ring 110 by means of a cam arrangement 112 that is retained in the groove 106 by the L-shaped flange 104.

Figure 9:
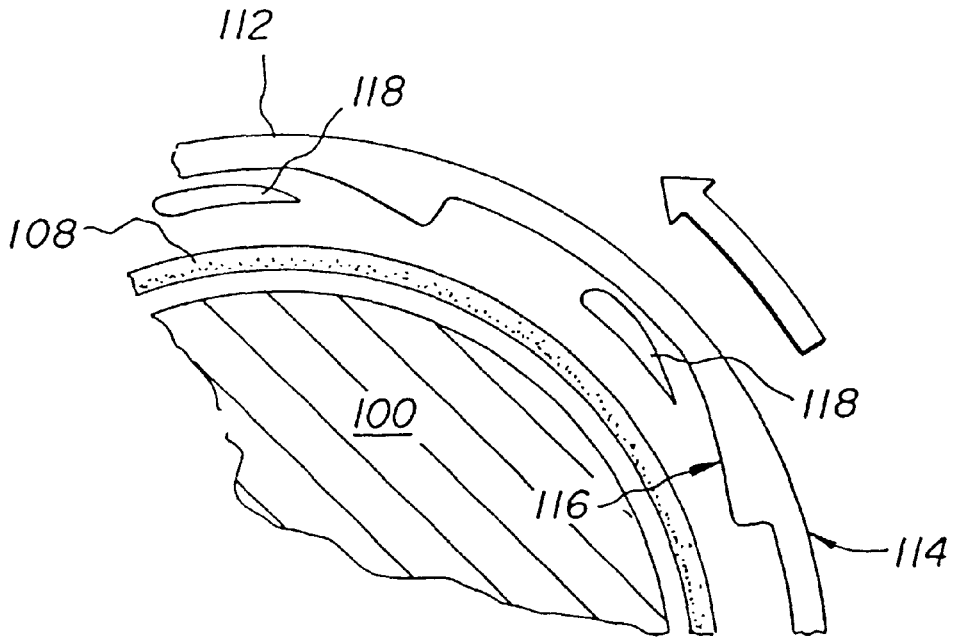
FIG. 9 shows part of an alternative mounting arrangement for a cathode of the cell.

The cam arrangement 112 is shown in enlarged detail in FIG. 9, and comprises an outer L-shaped cam holder 114 having a profiled inner cam surface 116, and a plurality of loose cams 118. Upon introduction of the cathode 108 into the groove 106, relative rotation between the lid 100 and the cathode 108 causes the cams 118 to engage with and to ride up the profiled cam surface 116, urging the flexible cathode 108 inwards and into contact with the ring 110. As can be seen from FIG. 8, electrical connection is made from the ring 110 to a terminal 120 on the outer surface of the lid 100. The cams may alternatively be provided as balls.

In a further modification, the cam arrangement may be made to operate and thus to grip the cathode as the cathode is inserted upwards into the groove 106.

Advantageously, the cathode is provided as a thin flexible sheet which is formed into a cylindrical configuration.

In the embodiments described above, the cathode is mechanically supported only at one end, namely its upper end adjacent the lid. Should there be a tendency for the cathode cylinder to unwrap, this can be eliminated by a strip of tape at the base. It will be appreciated that as silver is plated onto the cathode its rigidity will be enhanced and the profile of the cathode when first inserted will be retained. Alternatively, to prevent a flexible slit cathode from splaying out when newly introduced into the cell, it may be urged into the required shape, for example cylindrical, in its upper region. This can be achieved, for example, by widening the compression ring 22 downwards along part of the top of the cathode.

The electrical interconnection between the cathode and the closure member of the electrolytic cell as described above, results in relatively large contact surface area. For example, with a connection ring 20 having a height of 5 mm and a cathode 14 having a radius of 40 mm, the contact area is 12.6 $cm^2$, which provides a very low contact resistance. As a result, any fluctuation, for example due to variability in contact pressure, vibration, temperature or manufacturing tolerance, will make only a small difference to the plating voltage that is measured across the cell during operation. This not only facilitates the use of high plating currents, but is also beneficial when using voltage-sensitive control systems.

It is to be understood that features of the various embodiments of the cells described above may be combined as required.

The invention has been described in detail with particular reference to certain preferred embodiments thereof, but it will be understood that variations and modifications can be effected within the spirit and scope of the invention.

What is claimed is:

1. An electrolytic cell for the recovery of metal from a solution contained therein by plating onto a cathode thereof, the cell comprising:

an open topped container for containing said solution;

a closure arrangement for closing the top of said container to seal said solution therein and;

a cathode; said closure arrangement comprising (a) electrically insulated support means for supporting said cathode such that it extends into the solution in the container when in use and it is withdrawn from the solution and the container when the closure arrangement is lifted, and (b) electrical connection means that comprises a first part that is in electrical contact with said cathode, and a second part that extends from said first part and out through said closure arrangement; said cathode extending around the support means such that the inner surface of the cathode engages an exposed outer surface of the first part of said electrical connection means.

2. The cell of claim 1 wherein said cathode is of substantially cylindrical configuration.

3. The cell according to claim 1 wherein said first part of said electrical connection means is substantially annular and is embedded in said support means.

4. The cell of claim 1 wherein said cathode is retained within an annular groove of said support means.

5. The cell of claim 1 wherein said cathode is urged onto at least a portion of said support member by compression means.

6. The cell of claim 5 wherein said compression means acts on the outer surface of said cathode, and further comprises a compression ring.

7. The cell of claim 1 wherein an inner portion of said support means urges the cathode outwards into gripping contact with an outer portion of said support means.

8. The cell of claim 7 wherein said electrical connection means is mounted on the outer portion of said support means.

9. The cell of claim 1 wherein said support member is urged down onto an internal recess of said container by a lid of said closure arrangement.

10. The cell of claim 9 wherein said closure arrangement comprises a lid that is hinged to said container.

11. The cell of claim 1 wherein one of said cathode and support means comprises at least one projection that interengages with an aperture of the other of said cathode and support means, thereby to secure said cathode on said support means.

12. The cell of claim 1 wherein said cathode comprises a flexible member.

13. The cell of claim 1 wherein said cathode is formed from a conductive material supported by a non-conductive substrate.

14. The cell of claim 1 provided with an air bleed hole, extending from within the volume enclosed by said cathode.

15. The cell of claim 14 wherein said air bleed hole extends to an annular region between said cathode and said container.

16. The cell of claim 14 wherein said air bleed hole extends out through said closure arrangement.

17. The cell of claim 1 wherein said cathode is retained on said support means by a cam arrangement.

18. An electrolytic cell for the recovery of metal from a solution contained therein by plating onto a cathode thereof, the cell comprising:

an open topped container for containing said solution;

a closure arrangement for closing the top of said container to seal said solution therein and;

a cathode; said closure arrangement comprising (a) electrically insulated support means for supporting said cathode such that it extends into the solution in the container when in use and it is withdrawn from the solution and the container when the closure arrangement is lifted, and (b) electrical connection means that comprises a first part that is in electrical contact with said cathode, and a second part that extends from said first part and out through said closure arrangement; wherein an inner portion of said support means urges said cathode outwards into gripping contact with an outer portion of said support means.

19. An electrolytic cell for the recovery of metal from a solution contained therein by plating onto a cathode thereof, the cell comprising:

an open topped container for containing said solution;

a closure arrangement for closing the top of said container to seal said solution therein and;

a cathode; said closure arrangement comprising (a) electrically insulated support means for supporting said cathode such that it extends into the solution in the container when in use and it is withdrawn from the solution and the container when the closure arrangement is lifted, and (b) electrical connection means that comprises a first part that is in electrical contact with said cathode, and a second part that extends from said first part and out through said closure arrangement; wherein said support means is urged down onto an internal recess of said container by a lid of said closure arrangement.

20. An electrolytic cell for the recovery of metal from a solution contained therein by plating onto a cathode thereof, the cell comprising:

an open topped container for containing said solution;

closure arrangement for closing the top of said container to seal said solution therein and;

a cathode; said closure arrangement comprising (a) electrically insulated support means for supporting said cathode such that it extends into the solution in the container when in use and it is withdrawn from the solution and the container when the closure arrangement is lifted, and (b) electrical connection means that comprises a first part that is in electrical contact with said cathode, and a second part that extends from-said first part and out through said closure arrangement; said cathode being retained on said support means by a cam arrangement.

* * * * *